United States Patent [19]

Kobus et al.

[11] Patent Number: 4,843,999

[45] Date of Patent: Jul. 4, 1989

[54] BOAT SEAT

[76] Inventors: Robert C. Kobus, P.O. Box 14088, Minneapolis, Minn. 55414; Todd A. West, 537 South First St., LaCrescent, Minn. 55947

[21] Appl. No.: 224,995

[22] Filed: Jul. 27, 1988

[51] Int. Cl.[4] ..... B63B 29/00

[52] U.S. Cl. ..... 114/363; 114/347; 297/423; 297/313

[58] Field of Search ..... 114/347, 363; 440/101-105; 297/337, 195, 423, 313

[56] References Cited

U.S. PATENT DOCUMENTS

| | | | |
|---|---|---|---|
| 1,387,957 | 8/1921 | Zeidler et al. | 114/363 |
| 1,621,423 | 3/1927 | Long | 114/363 |
| 3,769,645 | 11/1973 | Lettman | 114/363 |
| 3,863,978 | 2/1975 | Gillings, Jr. | 296/63 |
| 4,310,193 | 1/1982 | Kolleas | 296/75 |
| 4,503,799 | 3/1985 | Masters | 114/347 |
| 4,589,699 | 3/1987 | Dungan | 297/423 |
| 4,650,249 | 5/1986 | Serber | 297/313 |
| 4,662,361 | 5/1987 | Patterson | 297/195 |
| 4,669,992 | 6/1987 | Morris | 441/65 |
| 4,672,911 | 6/1987 | Hodgins | 114/363 |

*Primary Examiner*—Joseph F. Peters, Jr.
*Assistant Examiner*—Edwin L. Swinehart
*Attorney, Agent, or Firm*—Lathrop & Clark

[57] ABSTRACT

A boat seat which effectively positions a person for paddling a boat such as a canoe or kayak includes an upper platform for supporting the posterior of the person and a lower platform for supporting the knees and shins of the person. The upper platform near its rear end is pivotally connected between the two frames on a substantially radial component of each frame near a rear pivot end thereof. The boat seat includes a device for adjustably stopping the downward pivotal movement of the upper platform front end at a position selected from a plurality of positions along a vertical component of each frame. The lower platform includes a back end which can rest on the boat floor. A front end of the lower platform is adjustably connected between two substantially horizontal brackets which are each affixed to one side in spaced opposition to each other. The lower platform front end can be connected to the brackets at a position selected from a plurality of positions along each horizontal bracket between the forward and rearward ends thereof.

21 Claims, 4 Drawing Sheets

BOAT SEAT

BACKGROUND OF THE INVENTION

1. Field of the Invention

The present invention relates to seating devices for supporting an individual. More specifically, the present invention relates to a seat which supports both the knees and the posterior of the individual while he or she is paddling a boat such as a canoe, kayak or other craft.

2. Description of the Prior Art

Generally, an individual paddling a canoe kneels with his or her legs folded rearwardly so that the knees and shins rest on the floor of the boat with little or no support for the posterior of the person. U.S. Pat. No. 4,669,992 to Morris, 4,672,911 to Hodgins and 3,769,645 to Lettman all disclose seats for use in recreational vehicles such as a canoe or water vehicle. Lettman discloses a canoe knee seat formed from a single molded piece of plastic and which is used in Canadian canoes. In these boats, the paddler kneels in the hull and braces himself with his posterior against a seat surface already within the canoe. The Lettman knee seat does not itself include a seat for the posterior of the individual and is not adjustable. Morris discloses a recreational waterslide with a seat on which the rider rests his or her posterior while the legs are bent at the knees with the knees and shins resting on the floor of the waterslide. A strap is placed over the rider's legs to maintain the rider in this seated position. Hodgkins discloses a canoe seat with a oarlock unit.

A knee-chair, which may be used in recreational vehicles for transportation use such as snowmobiles, is disclosed in U.S. Pat. No. 3,863,978 to Gillings, Jr. The Gillings, Jr. knee-chair generally includes a saddle shape surface upon which the posterior may rest with the thighs arranged astride the vertical sides thereof, and a pair of rearwardly facing surfaces which merge smoothly with the respective vertical sides. The Gillings, Jr. knee-chair does not appear to be adjustable. U.S. Pat. No. 4,589,699 to Dungan and U.S. Pat. No. 4,650,249 to Serber both disclose sit-kneel chairs which distribute the weight and position of the user for a healthy and comfortable position of the spine. The Dungan and Serber chairs are adjustable and specifically designed for use in an office.

U.S. Pat. No. 4,310,193 to Kolleas discloses a foot rest which includes a mounting bracket for attachment to the side panel of a vehicle driver's compartment. The foot rest bracket contains a series of vertically spaced keeper slots for receiving keeper studs on the foot rest member.

Individuals today are becoming more aware of the health benefits of outdoor exercise such as canoeing. However, at the same time, people are also leary of the problems which can be associated with exercise, such as knee injury and back injury, and the discomfort associated with prolonged kneeling in one position. For example, the conventional paddling position requires a person to kneel with full weight on the knees in order to achieve the maximum thrust in each stroke. In time, this position becomes very uncomfortable to all but the most seasoned canoists. Alternatively, the paddler can sit on a seat provided in most canoes or directly on the bottom of the boat, but the resulting "upright" position makes it difficult for the paddler to put his back into each stroke for maximum power. It therefore is desirable to have a seat for boats such as canoes which gives balanced support to the knees and posterior of the individual, which is adjustable, and which places the individual in a position suitable for maximum in paddling efficiency.

SUMMARY OF THE INVENTION

It is therefore a primary object of the invention to provide a boat seat which provides balanced support to the knees, shins and the posterior of an individual paddling a boat such as a canoe.

A second object of the invention is to provide a boat seat having a lower platform on which the knees and shins of the individual may rest, and which may be adjustably positioned forwardly and rearwardly.

Another object of the invention is to provide a boat seat with an upper platform on which the posterior of the individual may rest, and which may be positioned at various angles with respect to the boat floor.

An additional object of the invention is to provide a boat seat which allows the individual to be in an optimum position for paddling, and yet which places the individual in a relatively naturally balanced seated position.

These objects and others are met by the present invention which is directed to a boat seat which effectively positions a person for paddling a boat such as a canoe. The boat seat includes an upper "seat" platform for supporting the posterior of the person, means for pivotally connecting the upper seat platform to the sides of the boat, and means for adjusting the angle of the upper platform. The seat furthermore includes a lower platform for supporting the knees or shins of the person, the lower platform including a back end which can rest on the boat floor, and means for adjustably connecting the lower platform near its front end to and between both brackets at a position selected from a plurality of positions along each bracket between the forward and rearward ends thereof.

The boat seat of the present invention allows the user to sit, kneel, or sit/kneel in the boat in a position suitable for paddling. This position allows the user to balance his body weight between the upper and lower platforms consistent with a kneeling or semi-kneeling posture. Thus, the user is able to paddle the boat with increased comfort, less back stress, and a stronger stroke.

Other objects, features, and advantages of the invention will be apparent from the following detailed description taken in conjunction with the accompanying drawings wherein a preferred embodiment of the invention has been selected for exemplification.

DESCRIPTION OF THE PREFERRED EMBODIMENT

Figure 1:
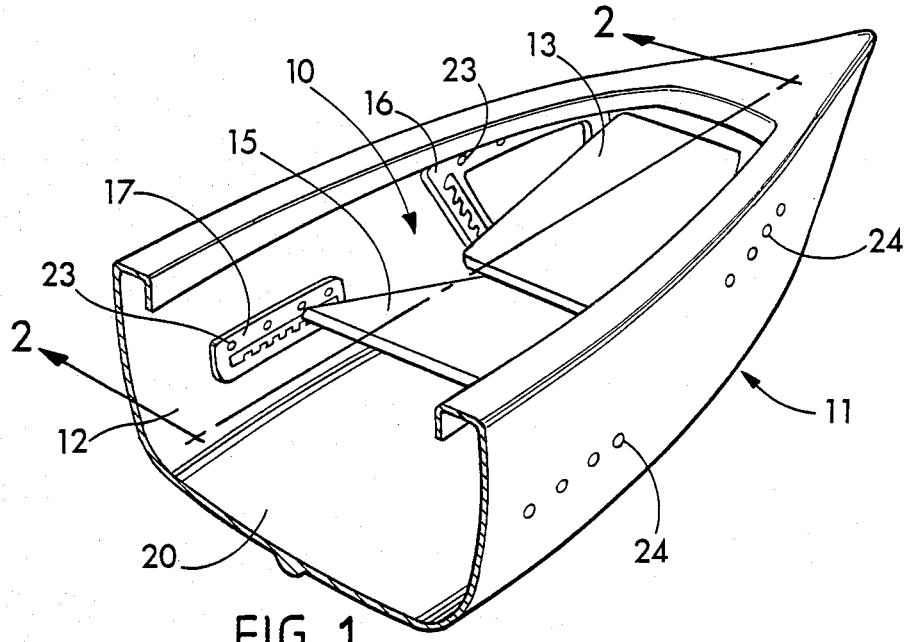
FIG. 1 illustrates a perspective view of the preferred boat seat mounted in the rear portion of a canoe.
Figure 2:
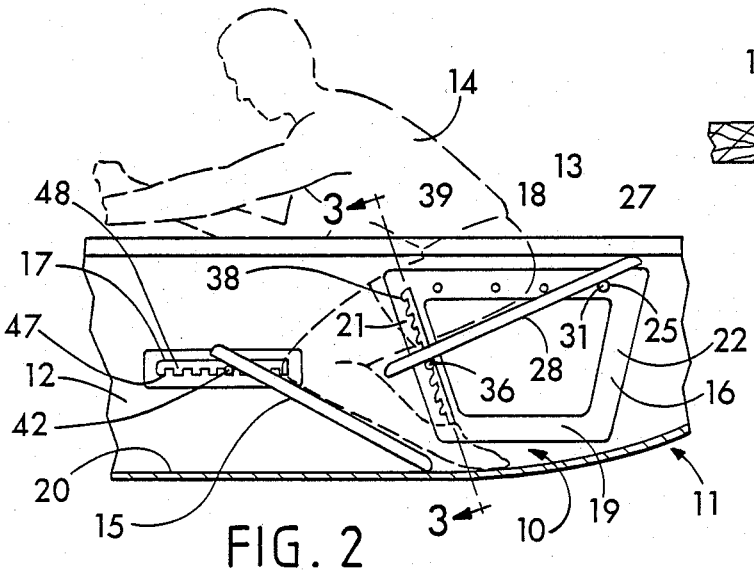
FIG. 2 illustrates a section view of a portion of the canoe and boat seat of FIG. 1 taken along section line 2—2 of FIG. 1.

Referring more particularly to the drawings, wherein like numbers refer to like parts, FIG. 1 shows a boat seat 10 constructed in accordance with the present invention shown in perspective view within a rear portion of a canoe 11. FIG. 2 shows a cross-sectional view of the boat seat 10 in the canoe 11 with the port side cut away to expose the seat 10 more clearly. As shown in FIGS. 1 and 2, the boat seat 10 includes an upper platform 13 for supporting the posterior of a person 14 and a lower platform 15 for supporting the knees or shins of the person 14. In a preferred embodiment, as illustrated in the drawings, the upper platform 13 is supported within the canoe 11 between the sides 12 of the boat by two substantially vertical frames 16 which are each affixed to one side 12 in spaced opposition to each other. FIGS. 1 and 2 show only the frame 16 which is affixed to the starboard side 12 of the boat 11. The frame 16 which is affixed to the port side 12 would be substantially the mirror image of the one shown. Similarly, the lower platform 15 is supported between the sides 12 by two substantially horizontal brackets 17 which are each affixed to one side 12 in spaced opposition to the other. Again, the bracket 17 on the port side is not shown, but is the mirror image of the bracket 17 shown on the starboard side 12.

As is best illustrated in FIG. 2, each frame 16 may be trapezoidal in shape and includes two substantially horizontal members 18 and 19 and two substantially vertical members 21 and 22 which are connected together as a one piece trapezoidal frame 16. As shown, each frame 16 is attached to the side 12 by four rivets 23 in rivet holes 24 although other means of attachment are within the scope of the invention. Although the trapezoidal shape is preferred, it is within the scope of the present invention to provide other shapes for the frame 16. Additionally, the members 19 and 22 may be omitted.

Figure 4:
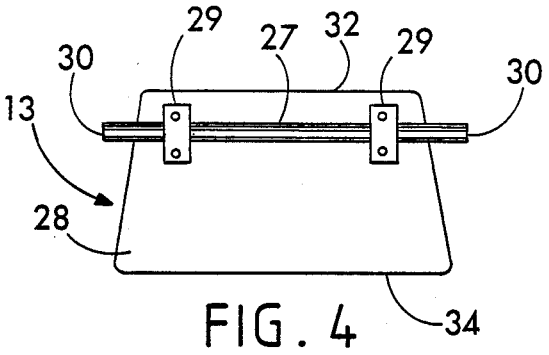
FIG. 4 illustrates a bottom perspective view of a preferred embodiment of the upper platform.
Figure 6:
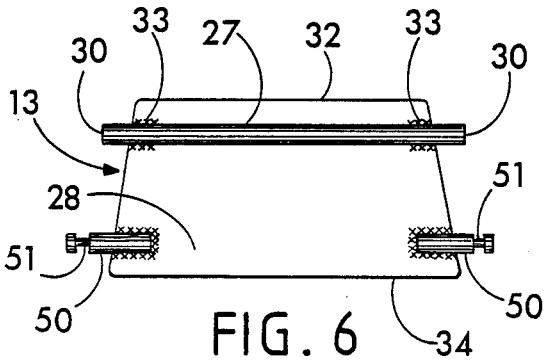
FIG. 6 illustrates a bottom elevational view of an alternative embodiment of the upper platform with studs instead of a bar for stopping the pivotal movement of the upper platform.

It is the intended purpose of the frame 16 to provide a means for rotatably connecting the upper platform 13 to the boat sides 12 and to position the upper platform at a desired angle for seating. In this manner, the upper platform 13 is pivotally connected between the two frames 16 on the horizontal member 18 by means of a transversely extending bar 27 attached to the bottom 28 of the upper platform 13 and pivotally connected to the horizontal members 18 at pivot points 25. As shown in FIGS. 4 and 6, the bar 27 is attached at or near the rear portion 32 of the platform 13 transversely to the bottom 28 of the upper platform 13 by means of brackets 29 (FIG. 4) or by welding 33 (FIG. 6). Additionally, the bar 27 may be molded to the bottom 28 of the upper platform 13 (not illustrated). The bar 27 has two ends 30 which each extend beyond one of the two sides of the upper platform 13 into a hole 31 located in the rear pivot end 25 of the member 18. Preferably, each hole 31 should have a larger diameter than the diameter of the bar ends 30, so that the bar ends 30 have substantial play within the holes 31. Thus the upper platform 13 is pivotally connected near its rear end 32 between the two members 18 near their rear pivot ends 25 so that the front end 34 of the upper platform 13 is able to pivot upwardly and downwardly.

Figure 3:
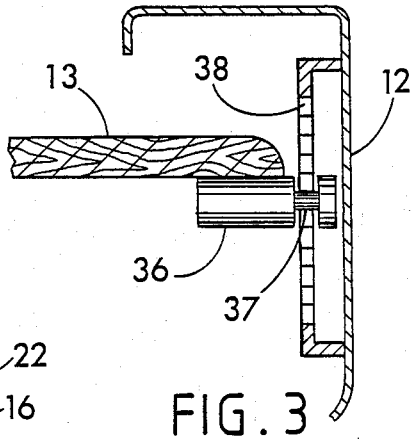
FIG. 3 illustrates a section view taken along section line 3—3 of FIG. 2.
Figure 3A:
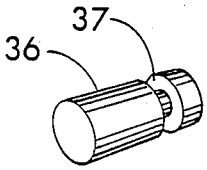
FIG. 3A illustrates a perspective view of a positioning stud illustrated in FIG. 3.

To be selectively positioned, the upper platform 13 and frames 16 must include some means for adjustably stopping downward pivotal movement of the front end 34 of platform 13 at a position selected from a plurality of positions along the frame member 21. As shown in FIGS. 1–3, the substantially vertical component 21 of both frames 16 has a plurality of diagonal keeper slots 38 for receiving positioning studs 36, which prevent the downward movement of the platform beyond a selected diagonal keeper slot 38. As illustrated in FIG. 3A, the positioning stud 36 is preferably notched at 37 to be received in the keeper slot 38 of the frame 16. Additionally, the substantially vertical member 21 is slightly spaced from the side 12, as illustrated in FIG. 3, and has a substantially longitudinal slot 39 which interconnects the diagonal slots 38 to allow the positioning stud 36 to be moved selectively through the longitudinal slot 39 from slot to slot to thereby selectively position the upper platform 13 with the studs 36 in the desired diagonal keeper slots 38. The notch 37 of each stud 36 fits into the diagonal keeper slot 38. By means of the studs 36 and diagonal keeper slots 38, the upper platform 13 may be adjusted to various angles desired by the user, including positioning the seat so that it is substantially parallel to the floor 20 or at a very sharp angle to the floor 20.

Figure 3B:
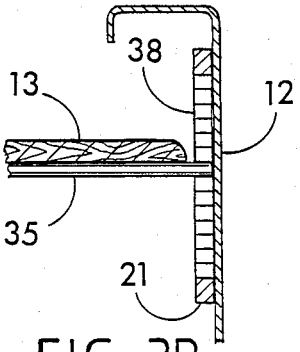
FIG. 3B illustrates a section view of a first alternative embodiment of the portion taken along section line 3—3 of FIG. 2.
Figure 3C:
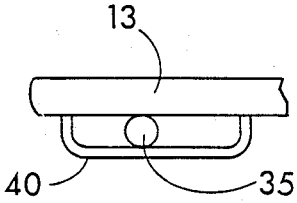
FIG. 3C illustrates a section view of a second alternative embodiment of the portion taken along section line 2—2 of FIG. 1.

As an alternative to the positioning studs 36, the downward movement of the platform 13 may be prevented by means of a detached bar 35, as illustrated in FIG. 3B, which when positioned in slots 38 of the vertical member 21, allows the front end 34 of the platform 13 to detachably rest upon the bar 35 at a select position. Alternatively, the bar 35 may be loosely attached to the bottom 28 of the platform 13 by hinges 40, illustrated in FIG. 3C, such that the hinges 40 allow the bar enough give to be moved into the longitudinal slot 39 in order to reposition the upper platform 13.

Figure 5:
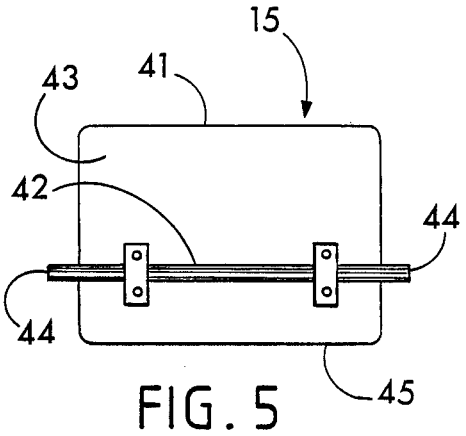
FIG. 5 illustrates a bottom view of the preferred embodiment of the lower platform.

As shown in FIGS. 1, 2 and 5, the lower platform 15 has a top surface, a bottom surface 43, two sides, a back end 41, and a front end 45. The platform 15 is mounted between the two brackets 17 such that its back end 41 can rest on the boat floor 20. Each bracket 17 is mounted to one side 12 with rivets 23. As shown in FIGS. 2 and 5, a bar 42 is transversely connected to the bottom 43 of the lower platform 15 near its front end 45, so that the bar ends 44 extend outwardly beyond the sides of the lower platform 15.

Formed in each of the two substantially horizontal brackets 17 are a plurality of substantially vertical keeper slots 47 which are positioned longitudinally along each bracket 17 for receiving the ends 44 of the bar 42. Each bracket 17 also has a substantially longitudinal slot 48 which interconnects the vertical slots 47 and allows the bar ends 44 to be moved selectively between different vertical slots 47 to thereby position the lower platform 15. The bar 42 and slot 47 arrangement allows the lower platform 15 to be positioned forwardly or rearwardly as desired, and also allows the lower platform 15 to be pivotable so that its back end 41 may be raised and an object such as a cushion placed thereunder to adjust the angular position of the lower platform 15.

The upper platform 13 and lower platform 15 may be padded or otherwise made for the comfort of the person using this seat 10. The upper platform may be provided with a back rest as desired. Additionally, the platforms 13 and 15 may vary in length, width and thickness. The frames 16 and brackets 17 may be attached to the sides 12 by some means other than the rivets 23.

Figure 7:
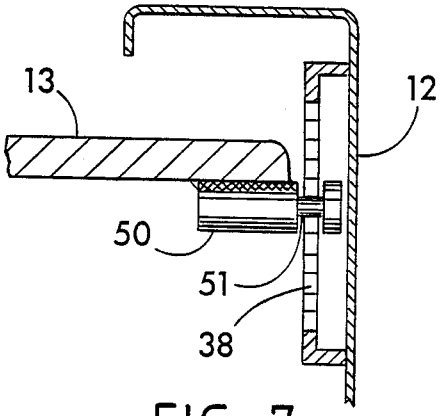
FIG. 7 illustrates a sectional view similar to FIG. 3, except showing the use of the studs of FIG. 6 in the slots of the frame.
Figure 8:
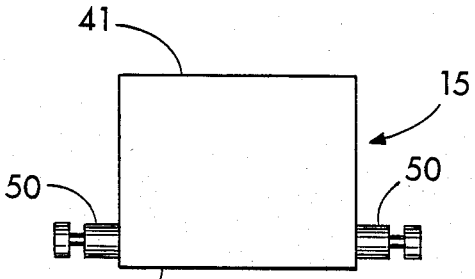
FIG. 8 illustrates a top elevational view of a lower platform with studs instead of a bar for positioning the lower platform within the slots in the horizontal brackets, thus demonstrating a first alternative means for positioning the lower platform.
Figure 10:
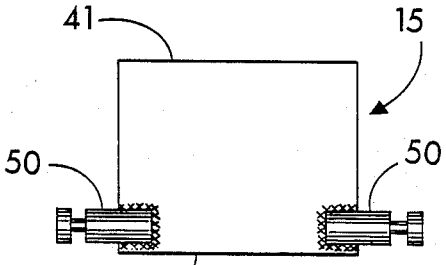
FIG. 10 illustrates a bottom elevational view of the lower platform shown in FIG. 9.

As shown in FIGS. 6–12, other means may be used for adjusting the position of the upper platform 13 with respect to the frames 16 and the lower platform 15 with respect to the brackets 17. For example, in FIGS. 6-8 studs 50, which are similar to positioning studs 36 of FIG. 3A but permanently mounted onto the bottom surface 28 of platform 13, extend sidewardly from the upper platform 13 beyond each of the two sides near the front end 34 thereof. Each stud includes a notch 51. In this embodiment, the substantially vertical component 21 of FIGS. 1 and 2 is also slightly spaced from the side 12, as shown in FIG. 7, and the notch 51 of each stud 50 fits into the diagonal keeper slots 38 preventing sideward motion. Similar modifications may be made to the lower platform 15 and to the substantially horizontal brackets 17 as illustrated in FIG. 8. As shown in FIGS. 6-8, each stud 50 extends sidewardly from an angle fixture 54 which is connected to the platform 13 or 15 near its front end 34 or 45 respectively.

Figure 9:
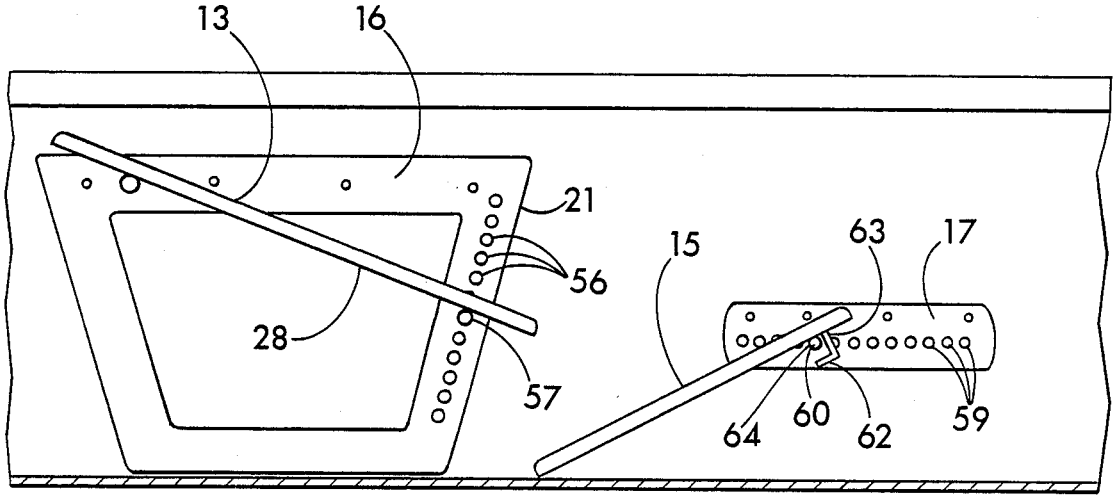
FIG. 9 illustrates a sectional view of a boat seat, similar to FIG. 2, with a second alternative means for positioning the platforms, with the starboard side and affixed structure removed to clearly disclose the boat seat.

A boat seat 10 with a second alternative means for positioning the upper platform 13 and lower platform 15 is illustrated in FIG. 9. The substantially vertical component 21 of each frame 16 has a plurality of pegholes 56 positioned longitudinally along the vertical component 21. A peg 57 is sized to fit into the pegholes 56 of the vertical component 21 and to extend outside of the selected peghole 56 into a pathway of the upper platform 13 to stop the downward pivotal movement of the platform when the bottom 28 of the platform 13 abuts against the pegs 57 inserted in both frames 16.

Similarly, the substantially horizontal brackets 17 each form a plurality of pegholes 59 positioned longitudinally along the brackets 17. Again, a peg 60 is sized to fit into the pegholes 59 and to extend outside of the selected peghole 59 below the lower platform front end 45. To prevent the lower platform 15 from slipping, a fixture 62 is preferably connected to each of the two lower platform flanks near the front end 45. Each fixture 62 includes a downwardly extending protrusion 63 which faces the corresponding bracket 17 and which defines an aperture 64 which can face the pegholes 59 when the sides of the lower platform 15 face the brackets 17. Each peg 60 also is sized to fit through the aperture 64 to thereby hold the lower platform 15 in position.

Figure 9A:
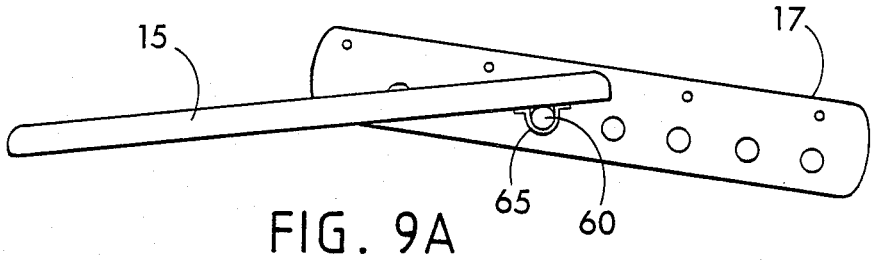
FIGS. 9A–C illustrate views of an alternative means of attaching the platforms of FIG. 9.
Figure 9B:
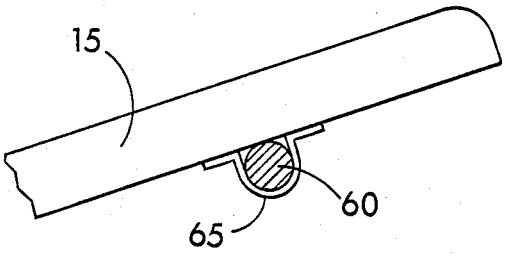
Figure 9C:
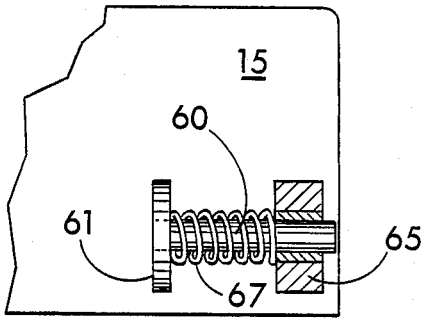

As illustrated in FIGS. 9A–9C with respect to platform 15, the peg 60 may be provided with a pull head 61. In this manner the platform 15 will be equipped with a hinge 65 through which the peg 60 will pass into the selected peghole 59. If desired the peg/hinge arrangement may be equipped with a spring 67 to give the peg 60 resilient movement into the peghole 59. It is to be understood that the same arrangement may be made with respect to pegs 57 of platform 13.

Figure 11:
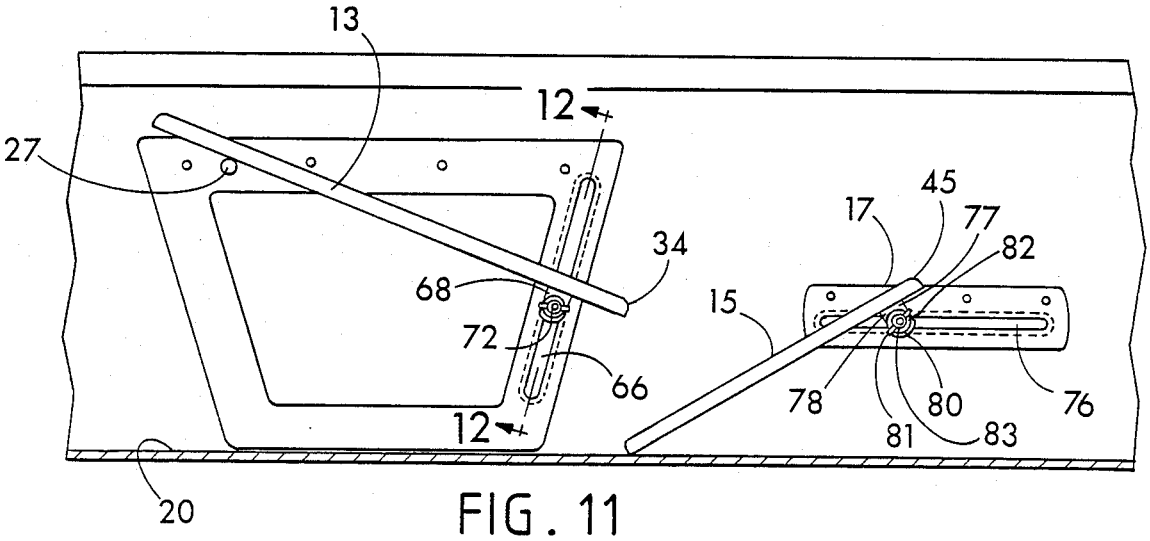
FIG. 11 illustrates a sectional view of a boat seat, similar to FIG. 2, with a third alternative means for positioning the platforms, with the starboard gunwale and affixed structure removed to more clearly disclose the boat seat.
Figure 12:
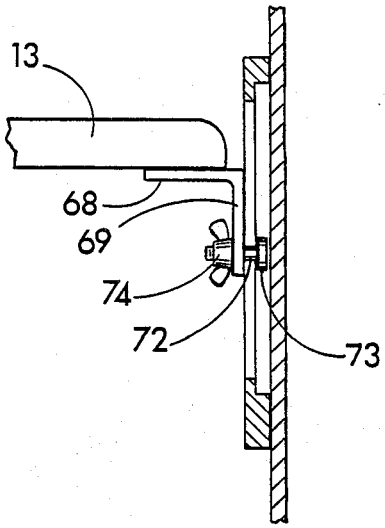
FIG. 12 illustrates a section view taken along section line 12—12 of FIG. 11.
Figure 12A:
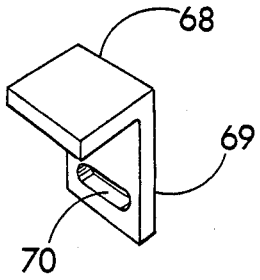
FIG. 12*a* illustrates a top perspective view of the angle fixture of FIGS. 11 and 12.

A boat seat 10 with a third alternative means for positioning the upper platform 13 and lower platform 15 is shown in FIGS. 11 and 12. The substantially vertical component 21 of the frames 16 has a substantially longitudinal slot 66 which extends along a major portion of the length of the vertical component 21. An angle fixture 68 is connected to the two sides of the upper platform 13 near its front end 34. Each fixture 68 includes a downwardly extending member 69 which faces the corresponding vertical component 21 and which defines an aperture 70 facing the slot 66 when the platform 13 is between the frames 16. A bolt 72 with a head 73 fits through the slot 66 and aperture 70. A wing nut 74 can be turned onto the bolt 72 and tightened to squeeze the fixture protrusion 69 and vertical component 21 between the nut 74 and head 73 to thereby position the upper platform 13. As shown in FIGS. 12 and 12A, the portion of the substantially vertical component 21 forming the longitudinal slot 66 should be slightly spaced from the side 12 to provide room for the head 73. The aperture 70 of fixture 68 is preferably oblong as shown to allow for the change in distance between the fixture 68 and the bar 27 as the platform 13 is pivotally raised or lowered. Alternatively, the fixture 68 may be slidably mounted on the bottom 28 of the platform 13 to adjust for any changes in distance between the bar 27 and the fixture 68.

Similarly, each substantially horizontal bracket 17 has a substantially longitudinal slot 76 along a major portion of its length. An angle fixture 77, similar to the fixture 68, is connected to each of the two lower platform 15 flanks near a front end 45 thereof. The fixtures 77 each include a downwardly extending member 78 which faces the corresponding bracket 17 and which defines an aperture 80 which faces the slot 76. A bolt 81 with a head 82 fits through the slot 76 and aperture 80. The wing nut 83 may be tightened onto the bolt 81 to thereby squeeze the fixture member 78 and bracket 17 between the nut 83 and head 82 to position the lower platform 15. Again, that portion of the bracket 17 around the slot 76 should be spaced from the side 12 to provide room for the head 82 to move back and forth.

Thus in the preferred embodiment and alternatives shown, the slots 38, 39, 47, 48, 66 and 76 and pegholes 56 and 59 are "voids" into which "projecting structures" in the form of bar ends 44, positioning studs 36 and 50, pegs 57 and 60, and bolts 72 and 81 extend from the platforms 13 and 15 to thereby position the platforms 13 and 15.

The boat seats 10 disclosed in FIGS. 1–12 are designed to allow a person to be seated comfortably in a boat such as canoe in a position which enables him to paddle the boat effectively. Normally a person paddling a canoe kneels on his or her knees to gain the greatest mechanical advantage. This position can become quite uncomfortable and difficult to maintain since the legs are bent at such an extreme angle and there is little or no support for the person's buttocks.

When using the boat seat 10 shown in FIGS. 1–4, the individual should raise the upper platform 13 to allow his or her feet to fit under the platform 13 as shown in FIG. 2. The position of the platform 13 should then be adjusted by placing the studs 36 into the desired diagonal keeper slot 38 so that the position of the upper platform 13 is comfortable. The lower platform 15 may then be adjusted by raising the lower platform front end 45 and moving the bar ends 44 through the longitudinal slot 48 to the desired vertical keeper slot 47 to determine where the lower platform 15 should be positioned. Additionally, a cushion or other object may be placed under the back end 41 of the lower platform 15 to change the angle at which the platform 15 is inclined. The individual is now in a position for paddling. The boat seat 10 shown in FIGS. 6–8 with a first alternative means for adjusting the position of the platforms 13 and 15 is adjusted in a similar manner to that just described.

FIG. 9 shows the boat seat 10 with the second alternative means for positioning the upper platform 13 and lower platform 15. Again, the upper platform 13 should be raised to allow the individual to place his or her feet underneath the platform 13. The pegs 57 may then be placed into the peg holes 56 to stop the downward pivoting motion of the upper platform 13 at the desired position. The pegs 60 should then be placed through the apertures 64 in the downwardly extending protrusions 63 of each of the two fixtures 62 and into the desired pegholes 59 in the brackets 17 to locate the lower platform 15 as desired. The means for adjusting the positions of the upper platform 13 and lower platform 15 as shown in FIGS. 1–10 allow the upper platform 13 to flip upwardly at all times so that the individual paddler may remove his or her feet quickly from underneath the platform 13, particularly in an emergency.

FIGS. 11–12 show a boat seat 10 with a third alternative means for adjusting the positions of the upper platform 13 and lower platform 15. Again, the upper platform 13 should be raised so that the individual may place his or her feet beneath the platform 13 as shown in FIG. 2. The upper platform 13 may then be placed in its desired position, and the wing nut 74 tightened to lock the upper platform 13 in position. Similarly, the lower platform 15 should be moved toward the bow of the boat 11 to its desired position. The wing nut 83 may then be tightened to lock the lower platform 15 in position.

All of the boat seats 10 shown in FIGS. 1–12 have frames 16 which are made with two horizontal members 18 and 19 and two vertical members 21 and 22 which form a trapezoid. The actual shape and configuration of the frames 16 may vary considerably. The vertical member 21, also known as the "substantially vertical component" might be a separate structure from the member 18. Nevertheless, it probably would be substantially vertical to allow for the up and down positioning of the upper platform 13. Additionally, the substantially vertical component 21 might be curved in shape, with the curve forming an arc around the rear pivot end 25 of the "pivot mount component" 18.

Figure 13:
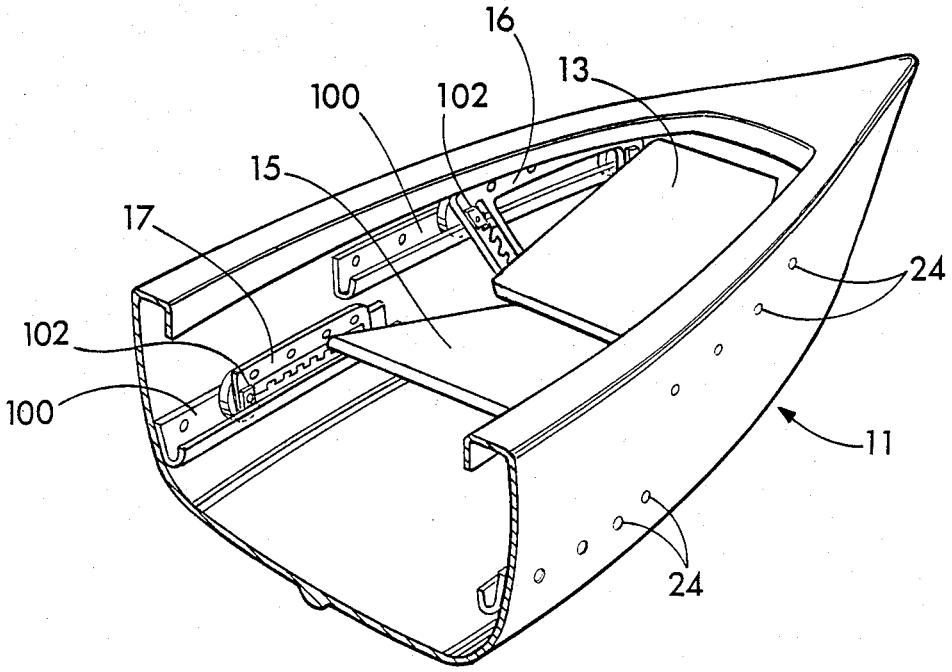
FIG. 13 illustrates a perspective view of the boat seat of FIG. 1 including a track to adjustably position the seat.

Additionally and as illustrated in FIG. 13, the boat seat of the present invention is designed to the adjustably positioned within the boat. This can be accomplished by means of tracks 100 upon which the frame 16 and bracket 17 are slidably attached. The frame 16 and bracket 17 may be adjustably positioned on the track 100 by any of a number of positioning devices, including clamping nuts 102. Alternatively, the rivet holes 24 may be placed in various positions throughout the sides 12 of the boat to allow the repositioning of the boat seat by removable rivets or nuts and bolts.

The boat seat itself can be made of any of a number of materials including, but not limited to, wood, metal, plastic or various other synthetic and natural compositions. It is also within the scope of the present invention to provide the boat seat with a back rest.

It is to be understood that the present invention is not limited to the particular arrangement and embodiments of parts disclosed an illustrated herein, nor to the materials specified, but embraces all such modified forms thereof as come within the scope of the following claims.

What is claimed is:

1. A boat seat which effectively positions a person for paddling a boat having opposing sides and a floor, comprising:

(a) an upper platform for supporting the posterior of the person, the upper platform having a front end, a back end, two sides, a top and a bottom;

(b) means for pivotally connecting the upper platform to and between the opposing sides of the boat;

(c) means for adjustably stopping downward pivotal movement of the upper platform front end:

(d) a lower platform for supporting and abutting the knees and shins of the person, the lower platform including a back end adapted to rest on the boat floor, a front end, two sides, a bottom portion and a top portion; and (e) means for adjustably connecting the lower platform to and between the opposing sides of the boat.

2. The boat seat of claim 1 wherein the means for pivotally connecting the upper platform to and between the opposing sides of the boat comprises two substantially vertical frames, each frame being affixed to one side of the boat in spaced opposition to each other.

3. The boat seat of claim 2 wherein said means for adjustably stopping the downward pivotal movement comprises a plurality of slots positioned along each of the two substantially vertical frames.

4. The boat seat of claim 2 wherein the upper platform pivotal connecting means includes a bar having two ends, the bar being transversely connected to the bottom of the upper platform near the back end thereof such that the ends of the bar extend beyond two sides of the upper platform, and the two substantially vertical frames comprise openings to pivotally receive the ends of the bar.

5. The boat seat of claim 2 wherein the pivotal movement stopping means includes a removable stud extending sidewardly to the upper platform beyond each of the two sides near the front end, and each substantially vertical frame includes a plurality of keeper slots for removably receiving and stopping the corresponding stud from downward movement, and a substantially longitudinal slot which joins the slots such that the corresponding stud is adapted to be moved selectively between the diagonal slots to position the upper platform.

6. The boat seat of claim 2 wherein the pivotal movement stopping means includes a bar having two ends, the bar being transversely connected to the bottom of the upper platform such that the ends of the bar extend beyond the two sides of the upper platform, and each of the substantially vertical frames defines a plurality of keeper slots for receiving and stopping the corresponding bar from downward movement beyond a selected slot and a substantially longitudinal slot which joins the slots, whereby the corresponding bar end can be moved selectively between the diagonal slots to position the upper platform.

7. The boat seat of claim 2 wherein the pivotal movement stopping means comprises a plurality of pegholes positioned longitudinally along the substantially vertical frame in a generally vertical direction, and a peg sized to fit into a selected peghole, the peg being adapted to extend outside of the selected peghole into a pathway of the upper platform to stop the downward pivotal movement when the bottom of the platform abuts against the pegs.

8. The boat seat of claim 7 wherein the peg is hingedly and removably connected to the bottom of the platform.

9. The boat seat of claim 2 wherein the pivotal movement stopping means comprises a substantially longitudinal slot; a fixture connected to the bottom of each of the two upper platform sides near the front end, each fixture including a downwardly extending protrusion adapted to face the corresponding substantially vertical frame, the fixture further defining an aperture which faces the longitudinal slot when the upper platform is positioned between the frames; a tightening bolt including a head and a nut adapted to tighten the fixture protrusion and the substantially vertical component between the nut and head to thereby position the upper platform.

10. The boat seat of claim 1 wherein said means for adjustably connecting the lower platform includes two substantially horizontal lower platform brackets, each bracket being affixed to one side of the boat in spaced opposition to each other.

11. The boat seat of claim 10 wherein the lower platform connecting means includes a bar having two ends, the bar being transversely connected to the bottom portion of the lower platform near a front end thereof such that ends of the bar extend beyond the two sides of the platform; and a plurality of substantially vertical keeper slots positioned longitudinally along each substantially horizontal bracket for receiving the corresponding bar end to thereby position the bar and lower platform, and a substantially longitudinal slot which joins the vertical slots and allows the bar end to be moved selectively between the vertical slots to position the lower platform.

12. The boat seat of claim 10 wherein the lower platform connecting means includes a substantially longitudinal slot; a fixture connected to each of the two sides of the lower platform near the front end thereof, each fixture including a downwardly extending protrusion which faces the corresponding bracket and which defines an aperture which faces the slot; a bolt adapted to fit through the slot and aperture, the bolt including a head; and a nut adapted to be tightened onto the bolt to squeeze the fixture protrusion and bracket between the nut and head to thereby position the lower platform.

13. The boat seat of claim 10 wherein the lower platform connecting means includes a plurality of pegholes positioned substantially longitudinally along the bracket; a fixture connected to each of the two sides of the lower platform near the front end, each fixture including a downwardly extending protrusion adapted to face the corresponding bracket and defining an aperture adapted to face the pegholes when the sides of the lower platform face the brackets; and a peg sized to fit into the selected peghole through the aperture to position the lower platform.

14. The boat seat of claim 1 further comprising means to adjustably position the boat seat between the opposing sides of the boat.

15. A boat seat which effectively positions a person for paddling a canoe having opposing sides and a floor, comprising:

(a) two substantially vertical frames, each frame being affixed to one side of the boat in spaced opposition to each other, each frame further including a pivot mount component positioned substantially above the floor and a substantially vertical component having a top end positioned substantially above the floor and forwardly from the pivot mount component, the substantially vertical component defining along at least a portion of its vertical length at least one first positioning slot;

(b) an upper platform for supporting the posterior of the person, the upper platform being pivotally connected to the pivot mount component of each frame so that the upper platform can pivot along a transverse axis between the pivot mount components, the upper platform having a front end, a back end, two sides, a top portion, and a bottom portion;

(c) a positioning stud adapted to be inserted into at least one first positioning slot in the corresponding substantially vertical component of each of the frames to thereby position the upper platform;

(d) two substantially horizontal brackets, each of which is being affixed to one side of the boat in spaced opposition to each other and being substantially above the boat floor, each bracket defining along at least a portion of its horizontal length at least one second positioning slot;

(e) a lower platform for supporting the knees and shins of the person, the lower platform including a back end adapted to be positioned on the boat floor, a front end and two sides; and (f) a projecting structure projecting sidewardly beyond each side of the lower platform so that the projecting structure can be inserted into a selected void in the corresponding substantially horizontal bracket to bear on a bottom of the selected void and to thereby position the lower platform which bears on the projecting structure.

16. The boat seat of claim 15 wherein at least one first positioning slot in the substantially vertical component opens generally upwardly so that the positioning stud can exit the first positioning slot when the upper platform is moved upwardly.

17. The boat seat of claim 15 wherein the positioning stud for the upper platform is connected to the sides of the upper platform.

18. The boat seat of claim 15 wherein the slots in the substantially horizontal frame open generally upwardly so that the projecting structure can exit the selected slots by being moved upwardly when a front end of the lower platform is moved upwardly.

19. The boat seat of claim 15 wherein the projecting structure on the lower platform is studs which are connected to the sides of the lower platform.

20. The boat seat of claim 15 wherein the positioning studs on the upper platform are formed by one bar having two ends adapted to fit into selected voids on the opposing frames in such a manner that the bottom of the upper platform near the front end rests upon the bar.

21. The boat seat of claim 15 wherein the projecting structure on the lower platform is formed by a bar which is transversely connected to a bottom of the lower platform near a front end thereof such that ends of the bar extend beyond each of the two sides of the lower platform.

* * * * *